US009217219B2

(12) United States Patent
Hanau et al.

(10) Patent No.: US 9,217,219 B2
(45) Date of Patent: Dec. 22, 2015

(54) METHOD FOR TREATING LAUNDRY AND SUITABLE LAUNDRY TREATMENT DEVICE FOR CARRYING OUT SAID METHOD

(75) Inventors: Andreas Hanau, Berlin (DE); Torsten Hasse, Nauen (DE); Hartmut Schaub, Brieselang (DE)

(73) Assignee: BSH HAUSGERÄTE GMBH, Munich (DE)

( * ) Notice: Subject to any disclaimer, the term of this patent is extended or adjusted under 35 U.S.C. 154(b) by 551 days.

(21) Appl. No.: 13/319,551

(22) PCT Filed: May 28, 2010

(86) PCT No.: PCT/EP2010/057419

§ 371 (c)(1), (2), (4) Date: Nov. 9, 2011

(87) PCT Pub. No.: WO2010/139625

PCT Pub. Date: Dec. 9, 2010

(65) Prior Publication Data

US 2012/0060302 A1 Mar. 15, 2012

(30) Foreign Application Priority Data

Jun. 5, 2009 (DE) ..... 10 2009 026 773

(51) Int. Cl.

| | |
|---|---|
| ***D06F 35/00*** | (2006.01) |
| ***D06F 39/02*** | (2006.01) |
| ***D06F 39/08*** | (2006.01) |
| ***D06F 58/20*** | (2006.01) |

(52) U.S. Cl.

CPC ..... *D06F 58/203* (2013.01); *D06F 35/005* (2013.01); *D06F 35/006* (2013.01); *D06F 39/02* (2013.01); *D06F 39/022* (2013.01); *D06F 39/028* (2013.01); *D06F 39/08* (2013.01); *D06F 39/083* (2013.01)

(58) Field of Classification Search

USPC ..... 68/12.18, 17 R

See application file for complete search history.

(56) References Cited

U.S. PATENT DOCUMENTS

| | | | |
|---|---|---|---|
| 5,917,118 | A | 6/1999 | Kosann et al. |
| 6,241,782 | B1 | 6/2001 | Vande Haar |
| 6,609,311 | B2 | 8/2003 | Hagemann et al. |

(Continued)

FOREIGN PATENT DOCUMENTS

| | | |
|---|---|---|
| CN | 1125275 | 6/1996 |
| CN | 1888224 | 1/2007 |

(Continued)

OTHER PUBLICATIONS

International Search Report PCT/EP2010/057419.

(Continued)

*Primary Examiner* — Michael Barr
*Assistant Examiner* — Levon J Shahinian
(74) *Attorney, Agent, or Firm* — Nixon & Vanderhye P.C.

(57) ABSTRACT

In a method for applying a treatment composition to a laundry item in a laundry treatment device having a rotatably mounted drum and a water supply, water is added to the laundry item in a first rotation step of the drum to set a pre-determined residual moisture content. A treatment composition is sprayed onto the laundry item with the aid of the water supply in a second rotation step of the drum, when the drum is rotated at a rotary speed which is equal to or greater than a centrifugal adhesion rotary speed.

21 Claims, 1 Drawing Sheet

(56) References Cited

U.S. PATENT DOCUMENTS

| | | | | |
|---|---|---|---|---|
| 7,047,666 | B2 | 5/2006 | Hahn et al. | |
| 8,196,439 | B2 | 6/2012 | Bae et al. | |
| 2003/0140427 | A1* | 7/2003 | Yamamoto et al. | 8/159 |
| 2004/0129032 | A1 | 7/2004 | Severns et al. | |
| 2005/0022319 | A1* | 2/2005 | Kim et al. | 8/159 |
| 2005/0262644 | A1 | 12/2005 | Oak et al. | |
| 2005/0262645 | A1 | 12/2005 | Yang et al. | |
| 2007/0151041 | A1* | 7/2007 | McAllister et al. | 8/149.2 |
| 2007/0151048 | A1* | 7/2007 | Palacin et al. | 8/602 |
| 2007/0283508 | A1 | 12/2007 | Wong et al. | |
| 2008/0276661 | A1 | 11/2008 | Bae et al. | |
| 2008/0276964 | A1* | 11/2008 | Hendrickson et al. | 134/18 |
| 2011/0162152 | A1 | 7/2011 | Hanau | |

FOREIGN PATENT DOCUMENTS

| | | | |
|---|---|---|---|
| DE | 10036850 | A | 10/2001 |
| DE | 102005046163 | | 3/2007 |
| DE | 102006003416 | A1 | 7/2007 |
| DE | 10 2008 021853 | | 11/2008 |
| EP | 0676497 | B1 | 9/1999 |
| EP | 1983086 | | 10/2008 |
| EP | 2042645 | | 4/2009 |
| WO | 03023122 | A1 | 3/2003 |

OTHER PUBLICATIONS

National Search Report DE 10 2009 026 773.5.

Chinese Office Action including Search Report and English Translation for corresponding Chinese Application No. 201080024290.3, mailed Aug. 5, 2013, 8 pages.

* cited by examiner

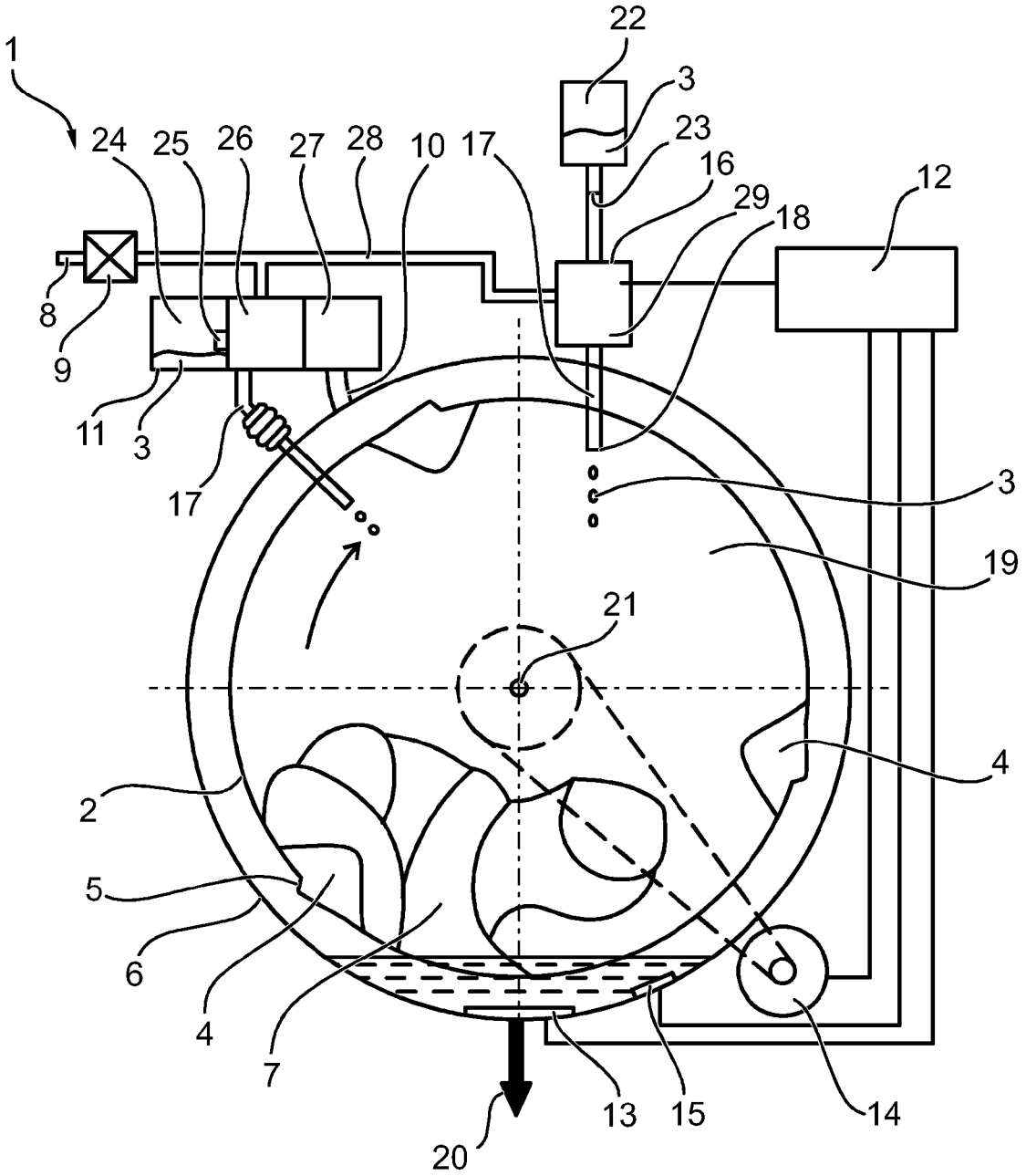
1
24
25
26
27
28
10
17
22
3
23
16
29
18
12
8
9
11
3
17
3
19
21
4
2
5
6
4
7
13
15
14
20

METHOD FOR TREATING LAUNDRY AND SUITABLE LAUNDRY TREATMENT DEVICE FOR CARRYING OUT SAID METHOD

This application is a U.S. National Phase of International Application No. PCT/EP2010/057419, filed May 28, 2010, which designates the U.S. and claims priority to German Application No. 102009026773.5, filed Jun. 5, 2009, the entire contents of each are hereby incorporated by reference.

BACKGROUND OF THE INVENTION

The present invention relates to a method for treating laundry in a laundry treatment device comprising a rotationally mounted drum and a water supply, and to a laundry treatment device that is particularly suitable for carrying out said method.

It is known to impregnate a laundry item in a laundry treatment device, for example, with aromatic substances. Commercial treatment methods generally operate on a batch system or foulard process. In the foulard process, lengths of cloth are brought into contact, in a large quantity of treatment solution, with the respective treatment composition being used. The level of extraction, defined as the percentage proportion of active agent that becomes deposited on the laundry item, depends strongly on the affinity of the active agent for the fibers, but is generally low.

For laundry treatment devices, particularly for laundry driers, methods and devices have been developed in order to treat laundry with aromatic substances or the like.

DE 601 19 356 T2 discloses a device for treating fabrics in a tumble drier. Cyclodextrins are mentioned as agents for odor neutralization and as perfume enhancers. These and numerous other substances are used, according to the teaching of DE 601 19 356 T2 for fabric conditioning and, for this purpose, are enclosed within a membrane which prevents the escape of liquids, but not the escape of gases. On operation of a drier, due to the action of heat, liquid evaporates and can escape out of the membrane sleeve and thus become distributed in the drier and in the laundry situated therein. Disadvantages of this type of laundry treatment are that no large volumes of treatment substances reach the laundry and not all treatment substances are suitable for evaporation. For example, microcapsules and cyclodextrins are intended to be distributed as a liquid.

DE 100 36 850 A1 discloses a device for dispensing a liquid product in the interior of a dishwashing or washing machine, particularly a mechanical spraying device with a reservoir and a nozzle, which is suitable for spraying liquids. With this device, no pressurized gas atomizer is used, but rather the reservoir is mechanically compressed and the liquid is driven through the nozzle and atomized. An atomizer of this type generates an aerosol that forms very large drops, which can lead to fleck formation on laundry items.

EP 1 431 443 A1 discloses a laundry drier equipped with an ultrasonic atomizer with which substances, for example aromatic substances, are to be introduced into the drum. An ultrasonic atomizer, although able to generate very fine aerosols is, however, unsuitable for distributing microdisperse fluids such as a microcapsule suspension in a space or for dispensing relatively large quantities of fluid in the shortest possible time.

EP 0 676 497 A2 discloses a method for spraying perfume oil onto laundry by means of a pressurized spray nozzle, the aromatic substance being sprayed onto laundry which is already dry, while the drum continuously rotates, in order to distribute the aromatic substance evenly. Also disclosed is a spraying device which is mounted in the feed opening cover of the drier. This method has the disadvantage that the laundry items tumbling about during movement of the drum are unevenly sprayed with the aromatic substance, which can lead to fleck formation.

WO 03/023122 A1 also discloses methods for treating textiles with treatment substances by spraying in a drum while said drum rotates at a speed below the centrifugal adhesion rotary speed.

DE 10 2006 003 416 A1 discloses a laundry treatment machine with a device for deodorizing clothes. For this purpose, a device with a spray nozzle is provided in the door seal of the laundry drum, said nozzle being able to dispense an active agent (e.g. cyclodextrins) as an aerosol into the interior of the drum. The drum is to move during the spraying such that tumbling of the laundry items present in the drum during the spraying is ensured.

EP 1 600 545 discloses a washing machine with a drum rotatably mounted in a container and dosing means that are operable in order to carry out a deodorizing procedure with laundry placed in the drum, independently of a washing procedure. The deodorizing agent preferably comprises a steam generator which is fluidically connected to water-producing means in order to generate steam therefrom. In particular, a silver solution is also used.

EP 1 605 091 A1 discloses a washing machine comprising a container and a drum rotatably mounted in the container, having a large number of holes, for accommodating laundry, and a pipe with an inlet and an outlet which communicate with an interior of the container, and means in order to draw air from the container into the pipe and to circulate said air back into the container. A spray head for a deodorizing agent is arranged in the pipe for spraying deodorizing agent into the air passing through the pipe.

For textile treatment (treating laundry items), therefore, essentially immersion methods and spraying methods are known. With immersion methods, textile treatments are used in various versions in a washing machine, for example, for fabric softening, impregnating, starching and for the application of ironing aids. With these methods, the relatively low extraction level is disadvantageous, since a high proportion of the treatment composition deployed passes unused into the waste water, which is not only uneconomical, but also causes environmental pollution. A disadvantage of the spraying method is that, given a large load, a very uneven distribution of the treatment composition on a laundry item in the drum results. Thus, an intended quantity and distribution of treatment composition ("treatment quality") is only achieved given a very low filling level of the drum.

BRIEF SUMMARY OF THE INVENTION

It is hence an object of the present invention to provide a method for treating a laundry item and a laundry treatment device suitable for carrying out said method, wherein said disadvantages in the prior art are reduced.

According to the invention, this aim is achieved with a method and a laundry treatment device as disclosed in the respective independent claim. Preferred embodiments of the invention are set out in the respective dependent claims. Preferred embodiments of the laundry treatment device correspond to preferred embodiments of the method and vice versa, even if herein not individually stated in each case.

The present invention therefore relates to a method for applying a treatment composition to a laundry item in a laundry treatment device with a rotatably mounted drum and a water supply, wherein (a) in a first rotation step of the drum, a pre-determined residual moisture content (for example, in the range from 50% to 70%, particularly 60%) is set by adding water to the laundry item; and (b) in a second rotation step of the drum in which the drum is rotated at a rotary speed $U_2$ which is equal to or greater than the centrifugal adhesion rotary speed, a treatment composition is sprayed onto the laundry item with the aid of the water supply.

The expression "laundry item" used here denotes one or more laundry items and includes textiles, particularly laundry, but also generally all objects that can be treated in a conventional laundry treatment device, particularly a conventional washing machine, such as table linen, bed linen, bags, curtains and the like. Apart from pure textiles, composite materials can also be treated, such as leather goods and other objects consisting of different materials, for example, fabric and leather. Therefore all materials which can be treated according to the method of the invention with the treatment substances described here are suitable.

Preferably, the laundry item comprises a finished clothing item, particularly ready-to-wear clothes. Particularly suitable for the method according to the invention are clothing items worn close to the body, for example, when said items are to be treated with skincare products.

In a preferred embodiment of the method according to the invention, the addition of water takes place in a rinsing step and the first rotation step of the drum takes place simultaneously with pumping out, or following pumping out, of the water.

The addition of water in step (a) preferably follows a washing phase in which the laundry item is generally cleaned with the aid of detergents. Such a washing phase is usually followed by a rinsing phase with water, the rinsing phase consisting of a plurality, in general up to three, rinsing steps.

According to the invention, it is preferred if step (a) corresponds to a last rinsing step.

According to the invention, it is preferred that the predetermined residual moisture content in step (a) is adjusted by a first rotation step of the drum at a centrifugal adhesion rotary speed. The centrifugal adhesion rotary speed is the system-related rotary speed at which the laundry items present in a drum lie against the drum wall due to the centrifugal force. In the case of washing drums with an approximately 470 mm diameter, said rotary speed is in the region of 70 to 100 revolutions per minute (70-100 rpm).

In the method according to the invention, it is advantageous if the first rotation step of the drum is carried out in step (a) at a rotary speed $U_1$ of ≥100 rpm. Particularly preferably, the rotary speed $U_1$ is in the range of 100 rpm to 150 rpm, or at least 230 rpm.

In a particularly preferred embodiment of the method according to the invention, the treatment composition is distributed in the laundry item in a third rotation step of the drum at a rotary speed $U_3$ which is lower than the centrifugal adhesion rotary speed.

The third rotation step of the drum in step (c) is preferably carried out at a rotary speed $U_2$ of less than or equal to 100 rpm.

In a particularly preferred embodiment of the invention, the steps (b) and (c) are carried out multiple times alternately until a desired treatment level is achieved. By this means, the substances of the treatment compositions can become particularly evenly distributed on and in the ring of laundry, since the surface of the laundry ring changes if the laundry is redistributed. The number of repetitions of steps (b) and (c) or the duration of said steps can be determined, for example, according to the quantity of laundry items introduced or the properties of the substances contained in the treatment composition.

The rotary speed of the drum can be varied during the first, second and/or third rotation step of the drum continuously or by setting pre-determined rotary speed steps.

According to the invention, it is preferred that the first rotation step and the third rotation step of the drum are different.

According to the invention, the treatment composition is sprayed onto the laundry item in liquid form with the aid of the water supply, possibly after a defined program interruption. Preferably, the treatment composition is sprayed onto the laundry item by means of a suitable injection device while the drum is moved at or above a centrifugal adhesion rotary speed. An injection device as defined by the invention comprises, in particular, a mixing container and an injection tube.

It is particularly preferable if the drum is moved, following spraying of the treatment composition onto the laundry item in step (b) at least at the centrifugal adhesion rotary speed, in a third rotation step in step (c) at a rotary speed below the centrifugal adhesion rotary speed in a reversing mode, the treatment composition only being dispensed by the injection device if the drum is moved at or above the centrifugal adhesion rotary speed.

The expression "treatment" should be understood within the context of the invention to mean a process wherein the laundry item is coated with the treatment substances contained in the treatment composition. Preferably, the treatment substances are firmly bound to the surface of the laundry item, particularly preferably covalently. Also possible, for example, is interspersing said substances between the fibers. Preferably, the treatment according to the inventive method should have the result that the treatment substances do not become detached from the fabric to a greater extent than is the case with commercially treated textiles during normal use of the treated laundry item, that is, typically when the clothing items are being worn. In the case of the microcapsules adhering to the laundry item, however, intentional destruction is provided in order to release the contents.

According to the invention, the type of treatment composition to be applied is unrestricted. The expression "treatment composition" used herein therefore also covers fabric softeners. For example, according to the invention, fabric softeners may therefore be rinsed in directly onto the laundry as late as during the third rotation step, for example, via the door seal. The quantity of fabric softener needed can therefore be significantly reduced compared with known methods.

The treatment composition used in the method according to the invention is preferably a liquid, i.e. a solution or a suspension and can comprise a variety of treatment substances such as aromatic substances, functionalizing substances, preferably cyclodextrins and/or microcapsules. However, conventional treatment substances can also be used.

Apart from impregnating agents, dyes, starches and the like, the treatment substances required in the fields of sports, wellness and lifestyle with the ever growing functionality of articles of clothing in those areas can also be used. Treatment substances contained in the treatment compositions to be used according to the invention are, in particular, cyclodextrins and microcapsules.

The treatment composition preferably used according to the invention comprises cyclodextrins and/or microcapsules and possibly further active agents. Active agents of this type can be selected from substances with which the microcapsules or cyclodextrins are to be loaded. Examples thereof are, in particular, aromatic substances, cosmetics, care products, for example, Aloe vera, anticellulite substances and the like. It has surprisingly been found to be possible to treat a laundry item with microcapsules and/or cyclodextrins not only in a commercial process, but also in a washing machine intended for domestic use and/or in a washer-drier.

Cyclodextrins are cyclic oligosaccharide compounds having a toroidal structure with a central hollow space, in which apolar organic compounds can be included. As a result of this property, they are used, for example, in air-freshening sprays. The cyclodextrin derivatives contained in these products bind compounds that cause unpleasant odors and serve also as carriers of aromatic substances.

Microcapsules (also called nanocapsules, or microspheres) are usually essentially spherical structures which have a shell and an internal space, usually with a diameter in the range from nanometers to <1 mm. Substances can be enclosed in the interior space thereof.

The microcapsules have a shell which, for example, comprises polymers which form a film in which finely dispersed liquid or solid phases can be enclosed. The shell material can comprise many different types of chemical compounds, for example, gelatin, gum arabic, agar agar, lactose, microcrystalline cellulose, modified starch, fatty acid esters, phospholipids, chitosan, alginates and collagen, as well as synthetic polymers such as polyacrylates, polyamides, polyvinylalcohol or polyvinylpyrrolidone.

Fibers and textile fabrics which are treated with mixtures of hydrophobic active agents and film-forming polymers (i.e. microcapsules) are disclosed by DE 10 2004 037 752 A1. Known microcapsules for textiles include, for example, the PCMs (phase change materials) which have a heat-regulating effect.

In the case of textiles treated with cyclodextrin derivatives or microcapsules, for example, outer clothing or pantyhose, the treating substances such as microcapsules are gradually destroyed or become detached during wearing and during a normal cleaning process, for example, in a washing machine. The treatment effect is therefore lost in the course of time. In the case of microcapsules, this destruction may be intended, so that the microcapsules are able to release their content at all. However, the user of the originally treated material has previously not had the possibility of treating said material anew for a plurality of wearing cycles.

A treatment with cyclodextrins is preferred, above all, for laundry items made from cotton materials. A variety of different materials can be treated with microcapsules.

It is a further object of the invention to provide a laundry treatment device with a rotationally mounted drum and a water supply for carrying out a method for applying a treatment composition onto a laundry item, wherein the laundry treatment device comprises means for carrying out the steps (a) setting a pre-determined residual moisture content in the laundry item by adding water and carrying out a first rotation step of the drum; and (b) spraying a treatment composition with the aid of the water supply onto the laundry item in a second rotation step of the drum at a rotary speed $U_2$ which is equal to or greater than the centrifugal adhesion rotary speed.

The means for carrying out the steps (a) and (b) are preferably also means for carrying out the addition of water in a rinsing step and the first rotary step of the drum simultaneously with or following pumping out of the water.

The laundry treatment device according to the invention is preferably a washing machine or a laundry drier, particularly preferably a washing machine.

A preferred washing machine according to the invention has, in general, apart from a drum rotationally mounted in a washing solution container, a washing solution outlet system arranged in the base of the washing solution container, a drive motor for the drum and a heating device.

In general, a laundry treatment device with a drum (e.g. a washing machine) has electrical means for rotating and stopping the drum. A washing machine according to the invention preferably also has a pressure sensor for determining a quantity of liquid contained in the washing solution container by means of a measured hydrostatic pressure.

Preferably, the laundry treatment device comprises an injection device for injecting a treatment composition into the drum and onto the laundry item. It is also preferred that the injection device for injecting a treatment composition is switchable independently of the drum.

By means of the third rotation step of the drum in step (c) provided in the inventive method according to a preferred embodiment, by the means described above, an improved distribution of the treatment composition onto the laundry item(s) is achieved. The distribution can be improved if, in a further preferred embodiment, the laundry treatment device comprises an additional structural feature for promoting a distribution of the treatment composition in the laundry item. This structural feature involves, in particular, a laundry agitator which is optimized with regard to the distribution of the treatment composition in the laundry item. A plurality or several of such laundry agitators, particularly three or four thereof is further preferred.

The aforementioned laundry agitator can be molded as an integral component into the drum or inserted as an additional component in the drum. It is also representative of a plurality of embodiments for the structural configuration which is conceivable, particularly, as an arrangement of special ribs or as a helically wound configuration of an inner part of the drum.

According to the invention, it is preferable that the injection device for injecting the treatment composition is regulable. The injection device for injecting treatment composition into laundry items is preferably regulable by a corresponding control loop which particularly comprises a control device of the laundry treatment device (e.g. a washing machine). By this means, controllable injection of treatment composition into the washing solution is possible. Apart from the possibility of a constant injection of treatment composition, which is only switchable on and off, a continuous or stepped variation of the quantity of injected treatment composition can be provided.

In the laundry treatment device according to the invention, a control device preferably with an associated program control system controls the addition of the treatment composition into the drum in a suitable manner and quantity. For careful and restrained dosing of the treatment composition, it is possibly advantageous if the treatment composition is injected into the drum at intervals. Under certain circumstances, the flow rate of the treatment composition per unit time from a pump used for transportation thereof should not be kept so low as would be required for the low total quantity of treatment composition needed. Since the surface of the laundry item is possibly large and the distribution of the treatment composition then requires a longer duration, for the careful injection of the treatment composition and the restrained working in thereof, it must be possible to select the smallest possible flow rate per unit time. For this purpose, an intermittent injection of the treatment composition is very suitable. For different sized loads of laundry items and differing process parameters of other types (e.g. different temperatures, different pre-moistening of the laundry items and different textile types), said injection should be further variable. When the measurability of process parameters permits, automatic adaptation of the feed quantity and speed are also possible.

In order to support the control of spraying of the treatment composition or the control of an injection device for the treatment composition by a control system, in a preferred embodiment, a suitable sensor for determining the type and/or quantity of treatment composition is also provided in the drum. As a suitable sensor, for example, an optical sensor, a conductivity sensor or a tensiometer can be used. Said sensor can feed the measured signals, via a signal line, to the control device for further processing.

Apart from the injection device preferably used in the laundry treatment device according to the invention, said laundry treatment device preferably also comprises a reservoir for the treatment composition. The reservoir is preferably refillable and is therefore preferably removable or detachable from the injection device. Preferably, the injection device has a mixing container into which the treatment composition present in the reservoir can be dosed. For this purpose, a dosing pump can be arranged between the reservoir and the mixing container, said pump being usable to control the dispensing of the treatment composition into the mixing container. This is particularly advantageous because the treatment compositions can be expensive substances which should be used as sparingly as possible.

In one embodiment of the present invention, the treatment composition added to the mixing container is injected into the drum and onto the laundry items by means of water from the water supply of the laundry treatment device.

This can be achieved, for example, in that water from the water supply is added to the treatment composition in the mixing container. The mixture of treatment composition and water can be sprayed into the drum and onto the laundry items.

By this means, not only can an optimum mixing ratio of concentrated treatment composition and water can be made. The pressure at which the water in the water supply is usually provided can also, in particular, be used for injecting the treatment composition or the mixture of treatment composition and water.

In an alternative embodiment, the treatment composition can be drawn by the suction effect of water flowing from the water supply into the mixing container and the resulting mixture of treatment composition and water can then be used for injection into the drum or onto the laundry items.

The injection device can be arranged either internally in the laundry treatment device according to the invention, for example, integrated therein, or externally or partially externally. Preferably, said injection device is detachably fastened or is at least connected to a detachably fastened reservoir.

The injection device can be part of a dispenser drawer via which washing agents (surfactants) are usually also conveyed into a washing machine. For this purpose, the dispenser drawer can have a plurality of chambers which are possibly connected to one another via dosing pumps.

In a further preferred embodiment of the invention, therefore, a reservoir and a mixing container are two chambers of a dispensing drawer, mutually connected by means of a pump, for example, a dosing pump.

In general, the water supply is separated from the mixing container by means of a suitable valve, for example, a solenoid valve.

The injection device can also be arranged entirely in the interior of a laundry treatment device according to the invention, for which purpose, in particular, the region of the door opening or the door is suitable. Said regions are regions which must be accessible to the user, thus ensuring that the user can insert an injection device or fill a reservoir. The injection device can however also be arranged in the region of the drum rear wall, for example, in the center, configured cylindrical or conical.

In another embodiment, the injection device is arranged externally on the housing, preferably at the door or at a porthole of the laundry treatment device according to the invention. For this purpose, an opening in the housing can be provided at the relevant site, equipped with the necessary sealing means and through which the injection device can be fed. Said arrangement is particularly advantageous since the reservoir at the injection device can easily be filled.

It is also possible to provide a separate door element, for example, as an accessory part which comprises an injection device and which can be mounted in place of the existing door. Said arrangement enables the user easily to undertake conversion of the laundry treatment device from normal operation to treatment operation. In a further preferred embodiment which can also be combined with the aforementioned and other embodiments, the reservoir is arranged at the injection device externally to the housing of the laundry treatment device according to the invention and is connected via a line, for example, a hose, to the injection device arranged in the interior. This has the advantage that the reservoir can be filled very easily. A hose connection between the reservoir and the injection device is also possible for other embodiments.

The injection device should preferably be connected to the drum. Said injection device is therefore preferably also arranged in the region of the door or the door opening. Said injection device can, however, also be arranged in the region of the drum rear wall.

Preferably, the injection device is arranged in the upper region of the treatment space. As a result, a jet of liquid with the treatment composition and water emerging therefrom can be distributed as well as possible and over the whole surface of the drum wall lying under the injection device. In a preferred embodiment, the injection device is arranged in the region of the door seal which seals the washing solution container. Preferably, the injection device is arranged in the upper region of the door seal and is therefore directed into the interior of the drum such that the fluid jet is directed toward the drum wall and a ring of laundry lying thereagainst. However, it is also conceivable for the liquid jet to be fed via the drum rotational axis in the region of the drum rear wall. According to the invention, the treatment composition is, in general, drawn by the water stream from the water supply out of the reservoir via a Venturi nozzle or placed under a high pressure. The reservoir can also already have pressure applied thereto or can be connected to an additional pressure container (e.g. a gas cartridge containing carbon dioxide or the like) and a mixing nozzle (e.g. a Venturi nozzle).

On opening a valve, preferably a solenoid valve, the emerging water stream draws the treatment composition along therewith. This effect can be brought about with the aid of a Venturi nozzle.

Spraying of the treatment substances is carried out, according to the invention, in the second rotation step at or above the centrifugal adhesion rotary speed. Surprisingly, the spraying of treatment substances onto a ring of laundry rather than onto laundry moved by a rotating drum leads to a significantly more even result. This is particularly the case if the injection phases take place at least at the centrifugal adhesion rotary speed, alternating with phases of reversal at a lower rotary speed (below the centrifugal adhesion rotary speed) in a third rotation step of step (c), wherein the treatment composition is only dispensed whilst the drum is moved at or above the centrifugal adhesion rotary speed.

Preferably, in a third rotary step, the drum is moved at a rotary speed below the centrifugal adhesion rotary speed, preferably at a rotary speed in the range of 35 rpm to 65 rpm, preferably 45 rpm to 55 rpm. Periodic reversal with pauses suggests itself for said step. For example, 5 to 20 seconds of rotation in one direction, a pause for 1 to 5 seconds, then 5 to 20 seconds of rotation in the opposite direction. This procedure is suitably repeated once or multiple times. Said rotary step ensures that the laundry item to be treated is redistributed. At the same time, the treatment composition is able to become better distributed in the laundry item and to wet said item evenly and without fleck formation. The two steps can also be repeated. Overall, a treatment period in the range of 20 minutes to 120 minutes, preferably 30 minutes to 110 minutes, particularly preferably 40 minutes to 100 minutes and especially preferably 50 minutes to 90 minutes, is advantageous.

In said procedure, expediently in the range of 500 ml to 2000 ml of liquid is sprayed. However, the quantity depends on the type of the treatment composition and on the quantity of the laundry item to be treated. In the case of cyclodextrins and microcapsules, a volume in the range of 700 ml to 1000 ml is advantageous. The laundry item should preferably be wetted within the range of 30% to 70% of the dry weight thereof.

If the laundry item is brought into contact with a treatment composition comprising microcapsules and/or cyclodextrins, it is expedient to fix the treatment substances onto the laundry item immediately following the spraying.

It can also be expedient, after bringing the treatment substances into contact with the laundry item, to provide a working-in time during which the laundry item is able to absorb the treatment composition until full, so that the most even possible distribution of the treatment substances on the laundry item is ensured. The working-in time can be readily determined by a person skilled in the art.

In a further preferred embodiment, the treatment composition is fixed following application onto the laundry item, preferably with a heat treatment or a chemical treatment. Therefore, following bringing the laundry item and the treatment composition into contact, microcapsules and/or cyclodextrins possibly present in the treatment composition are preferably fixed onto the laundry item.

Where heat treatment is used, drying with a laundry drier is particularly suitable. Particularly preferably, said drying is carried out in the same drum. For this purpose, the use of a washer-drier is therefore particularly preferable.

The heat treatment preferably comprises treatment at a temperature in the range of 80° C. to 150° C., more preferably in the range of 90° C. to 140° C., particularly preferably in the range of 100° C. to 120° C. and especially preferably at 130° C. These temperatures can already be achieved in conventional driers and washer-driers. In the menu or operating panel of the laundry treatment device, a separate point can be provided for said heat treatment step (e.g. "Fix 130° C."). Fixing can also be carried out at higher temperatures, for example, up to 180° C., in particular 150° C. to 170° C., provided the laundry treatment device is configured therefor. Drying should preferably be carried out with reversing in order to ensure an even temperature development in the laundry item. On use of the whole method in a washer-drier, the fixing can also be carried out in the same device. The drying time depends on the type and quantity of the laundry item, wherein the most complete possible drying is preferably performed.

The treatment substances can also be fixed chemically. Following the fixing, if necessary, excess treatment composition is removed, possibly by means of one or more rinsing procedures and/or by spinning.

The drier function of a washer-drier possibly used is suitable for the step of fixing the treatment substances. To this end, a special program which can preferably run following a normal washing procedure, but also independently thereof can be provided for this purpose. Separate devices can also be used, for example, first a washing machine for the treatment and subsequently a drier for fixing the treatment substances to the laundry item.

One advantage of the method according to the invention is that, in general, spinning off of excess treatment composition is not necessary, since said excess has generally been applied in a minimum quantity matched to the low residual moisture of the laundry item.

In an extension of the method according to the invention, it is not only the laundry item that is provided with the treatment composition, but rather the treatment composition is laden with active agents, for example, an aromatic substance, cosmetics and the like. Cyclodextrins are particularly suitable for such loading, since the hollow structure thereof is able to accommodate molecules.

In certain embodiments, it can be advantageous that the laundry item is subjected to a pre-treatment step before the application of the treatment composition. Preferably, the pre-treatment step comprises a chemical activation of the surface of the laundry item.

The method according to the invention and the laundry treatment device according to the invention have distinct advantages. One advantage of the invention is the avoidance of losses of treatment substances and environmental pollution via waste water containing treatment substances. Using batch methods in a washing machine would lead to treatment substance losses of over 50%. In the case of the present invention, the loss level is much lower. There is a significant improvement in the ecological effects for all forms of textile treatment. Furthermore, a more even distribution of the textile treatment (treatment composition) on the laundry items treated is brought about. The invention enables a significantly improvement in extraction level and, at the same time, improved evenness compared with the known methods.

Furthermore, the method according to the invention is not necessarily associated with additional costs in the laundry treatment device.

A further advantage of the method according to the invention is the first treatment of clothing items rather than lengths of cloth, particularly conventional ready-to-wear items and the re-treatment of such ready-to-wear items when the treatment substances have been used up.

Surprisingly, laundry items, particularly textiles can be provided with special treatment substances, even in a domestic washing machine, a domestic laundry drier or washer-drier. The method according to the invention also permits the spraying of small quantities of treatment compositions with little loss onto laundry items to be treated. This applies particularly for the expensive cyclodextrins and microcapsules, for which addition to a washing solution is not acceptable due to the high wastage levels on rinsing.

BRIEF DESCRIPTION OF THE DRAWINGS

The invention will now be described in greater detail by reference to FIG. 1, which illustrates the invention without restricting it.

FIG. 1 is a schematic representation illustrating the relevant parts of a laundry treatment device according to the invention which is configured here as a washing machine 1 in which a method according to the invention can be carried out. Other embodiments are conceivable.

DETAILED DESCRIPTION OF EXEMPLARY EMBODIMENTS OF THE PRESENT INVENTION

The washing machine 1 of the embodiment shown in FIG. 1 has a washing solution container 6 in which a drum 2 is rotatably mounted and can be driven by a drive motor 14. The rotary axis 21 of the drum 2 is oriented by a small angle (e.g. 13°) upwardly out of the horizontal toward the front, so as to provide easier access to and viewing of the interior of the drum 2. With this arrangement, in conjunction with specially configured laundry agitators 4 and scoop devices 5 for the washing solution 6 at the inner surface of the drum wall, intensification of the drenching of the laundry items 7 with washing solution or water, and in the step of applying treatment composition 3, a better distribution of the treatment composition 3 is also achieved.

The washing machine 1 is connected, via an electrically controllable valve (solenoid valve) 9 to a domestic water supply 8 (not shown). In the washing machine 1 shown in FIG. 1, the domestic water supply 8 is connected via a water pipe 28 to a dispenser drawer 11 and an injection device 16. The injection device 16 comprises an injection tube 17 with a tip 18 and a mixing container 29. The mixing container 29 is connected to a reservoir 22 for treatment composition 3. The feeding in of treatment composition 3 can be controlled via a closing mechanism 23 (e.g. a dosing device or dosing pump) arranged between the reservoir 22 and the mixing container 29.

In the embodiment of the invention shown in FIG. 1, the dispenser drawer 11 can assume the function of an injection device in cooperation with an injection tube 17. For this purpose, a first chamber 24 of the dispenser drawer 11 is provided as a reservoir for treatment composition 3. An adjacent second chamber 26 functions as a mixing container for mixing treatment composition stored in the first chamber 24 with water from the water pipe 28. The water from the water pipe 28 dilutes and conveys the treatment composition 3. For this purpose, a treatment composition 3 possibly conveyed with a dosing device (dosing pump) 25 into the mixing container (mixing chamber) 26 can be diluted via a subsequent introduction of water from the water pipe 28 and said composition can then be sprayed via the injection tube 17 onto the laundry items 7 situated in the drum 2.

Also provided in the dispenser drawer 11 is a washing agent drawer 27 from which the water from the water pipe 28 can transport washing agent portions into the washing solution container 6. Also situated in the washing solution container 6 is a heating device 13. The valve 9 and the heating device 13 are controlled by means of a control device (program control system) 12 depending on a program sequence, which is linked to a time program and/or to the achievement of certain measured values of parameters such as washing solution level, washing solution temperature, rotary speed of the drum 2, addition of rinsing water, pumping out of washing solution or rinsing water, added quantity of treatment composition 3, etc. within the washing machine 1.

A washing solution outlet system 20 which, according to conventional practice comprises, apart from the relevant pipes, an outlet valve and a washing solution pump, is represented only schematically for the sake of clarity.

The injection tube 17 projects, in each case, into an upper region 19 of the drum 2.

The laundry agitators 4 are optimized as additional structural formations on the drum 2 in order to promote the distribution of the treatment composition 3 in the laundry item 7.

Regulation of the distribution of treatment composition 3 is carried out by means of a control loop comprising a sensor 15 for determining the treatment composition 3 and the control device 12 so that, whether by alternating switching on and off of the injection device 16 or variation of the power thereof, the quantity of treatment composition 3 available for treating the laundry items 7 is monitored and, particularly, also restricted.

The invention claimed is:

1. A method for applying a treatment composition to a laundry item in a laundry treatment device having a rotatably mounted drum, a water supply, a reservoir for the treatment composition, and an injection device with a mixing container into which the treatment composition can be dosed, said method comprising:

adding water to the laundry item in a first rotation step of the drum to set a pre-determined residual moisture content;

adding the treatment composition to the mixing container from the reservoir prior to contacting the laundry item; and spraying the treatment composition from the mixing container onto the laundry item in a second rotation step of the drum with the aid of the water supply, when the drum is rotated at a rotary speed which is equal to or greater than a centrifugal adhesion rotary speed, wherein the treatment composition does not comprise laundry detergent.

2. The method of claim 1, wherein the adding step is executed in a rinsing step, with the first rotation step of the drum taking place simultaneously with pumping out or following pumping out of the water.

3. The method of claim 1, wherein the pre-determined residual moisture content is set by rotating the drum in the first rotation step at the centrifugal adhesion rotary speed.

4. The method of claim 1, wherein the drum rotates in the first rotation step at a rotary speed of ≥100 revolutions per minute (rpm).

5. The method of claim 1, further comprising distributing the treatment composition in the laundry item in a third rotation step of the drum at a rotary speed which is lower than the centrifugal adhesion rotary speed.

6. The method of claim 1, wherein the spraying step is carried out with the injection device.

7. The method of claim 6, further comprising moving the drum in a third rotation step at a rotary speed below the centrifugal adhesion rotary speed in a reversing mode, and dispensing the treatment composition by the injection device only when the drum is moved at or above the centrifugal adhesion rotary speed.

8. The method of claim 1, further comprising a washing phase in which the laundry item is cleaned with the aid of laundry detergent, the washing phase occurring prior to the first rotation step.

9. The method of claim 1, wherein the treatment composition comprises fabric softener.

10. The method of claim 1, wherein the treatment composition comprises an impregnating agent, a dye, a starch, a cyclodextrin or a microcapsule.

11. The method of claim 1, further comprising fixing the treatment composition with a heat treatment or a chemical treatment following the second rotation step.

12. The method of claim 1, further comprising chemically activating a surface of the laundry item prior to spraying the treatment composition.

13. The method of claim 1, wherein the treatment composition is fixed to the laundry item.

14. The method of claim 13, wherein the treatment composition is bonded to a surface of the laundry item, or introduced between fibers of the laundry item, or bonded to the surface of the laundry item and introduced between the fibers of the laundry item.

15. A laundry treatment device, comprising a rotationally mounted drum;

a water supply adapted to add water to the drum to thereby set a pre-determined residual moisture content in a laundry item in the drum in a first rotation step of the drum;

a reservoir for a treatment composition, and an injection device with a mixing container into which the treatment composition is adapted to be dosed from the reservoir prior to contacting the laundry item, the injection device being adapted to cooperate with the water supply and to apply the treatment composition onto the laundry item in the drum by spraying the treatment composition with the aid of the water supply onto the laundry item in a second rotation step of the drum at a rotary speed which is equal to or greater than a centrifugal adhesion rotary speed, wherein the treatment composition does not comprise laundry detergent.

16. The laundry treatment device of claim 15, constructed in the form of a washing machine.

17. The laundry treatment device of claim 15, wherein the device is an injection device adapted to inject the treatment composition into the drum and onto the laundry item.

18. The laundry treatment device of claim 17, wherein the injection device is switchable independently of the drum.

19. The laundry treatment device of claim 17, wherein the injection device is regulable.

20. The laundry treatment device of claim 15, further comprising a distributor adapted to promote a distribution of the treatment composition in the laundry item.

21. The laundry treatment device of claim 20, wherein the distributor is a laundry agitator which is optimized with regard to the distribution of the treatment composition in the laundry item.

* * * * *